US006435660B1

(12) United States Patent
Ozaki et al.

(10) Patent No.: US 6,435,660 B1
(45) Date of Patent: Aug. 20, 2002

(54) INK JET RECORDING HEAD SUBSTRATE, INK JET RECORDING HEAD, INK JET RECORDING UNIT, AND INK JET RECORDING APPARATUS

(75) Inventors: Teruo Ozaki, Yokohama; Koromo Shirota, Kawasaki; Masahiko Kubota; Ryuji Katsuragi, both of Tokyo; Hidehiko Kanda, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/672,060

(22) Filed: Sep. 29, 2000

(30) Foreign Application Priority Data

Oct. 5, 1999 (JP) ..... 11-284944

(51) Int. Cl.[7] ..... B41J 2/135; B41J 2/05
(52) U.S. Cl. ..... 347/45; 347/63
(58) Field of Search ..... 347/56, 64, 63, 347/67, 45

(56) References Cited

U.S. PATENT DOCUMENTS

| | | | | |
|---|---|---|---|---|
| 4,596,994 A | * | 6/1986 | Matsuda et al. | 347/63 |
| 4,723,129 A | | 2/1988 | Endo et al. | 347/56 |
| 4,740,796 A | | 4/1988 | Endo et al. | 347/56 |
| 4,980,703 A | * | 12/1990 | Sakurai | 347/63 |
| 5,451,994 A | | 9/1995 | Takahashi et al. | 347/64 |
| 5,594,479 A | | 1/1997 | Inoue et al. | 347/45 |
| 5,660,739 A | | 8/1997 | Ozaki et al. | 216/27 |
| 5,847,730 A | * | 12/1998 | Miyashita et al. | 347/45 |
| 5,896,147 A | | 4/1999 | Mori et al. | 347/61 |

FOREIGN PATENT DOCUMENTS

| | | | |
|---|---|---|---|
| EP | 0318982 | 6/1989 | B41J/3/04 |
| EP | 0816466 | 1/1998 | C09K/3/18 |
| JP | 11042798 A | 2/1999 | B41J/2/175 |
| JP | 11240156 A | 9/1999 | B41J/2/05 |

OTHER PUBLICATIONS

Patent Abstracts of Japan; vol. 1997, No. 11; publication date Jul. 22, 1997.
Patent Abstracts of Japan; vol. 1996, No. 11; publication date Jul. 23, 1996.
Patent Abstracts of Japan; vol. 1997, No. 05; publication date Jan. 21, 1997.

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

To provide an ink jet recording head substrate, an ink jet recording head, an ink jet recording unit, and an ink jet recording apparatus which allow scorch deposits on a heating section to be prevented by exerting on the section effect of providing super-hydrophilicity. The ink jet recording head substrate includes heating resistors formed through an insulating layer on a substrate which produce thermal energy used to eject ink, and the ink jet recording head includes an ejection orifice through which ink is ejected, and ink path which communicates with the ejection orifice and has a section exerting on the liquid thermal energy used to eject the liquid and heating resistors which produce thermal energy and an area corresponding to a heating section in which heat produced by the heating resistors acts on ink is given super-hydrophilicity treatment, and a contact angle between the area and water is 5° or less.

21 Claims, 9 Drawing Sheets

INK JET RECORDING HEAD SUBSTRATE, INK JET RECORDING HEAD, INK JET RECORDING UNIT, AND INK JET RECORDING APPARATUS

BACKGROUND OF THE INVENTION

1. Field of the Invention

The present invention relates to a substrate intended to configure an ink jet recording head (hereinafter also called an ink jet head) which performs operations, such as recording or printing characters, symbols, images, etc. by ejecting functional liquid, such as ink, against record bearing media, including paper, a plastic sheet, cloth, and an article; an ink jet head, which is configured by using the substrate; a recording unit which includes an ink reservoir for reserving ink to be fed to the ink jet head such as an ink jet pen; and an ink jet apparatus in which the ink jet head is installed.

Recording units according to the present invention, such as an ink jet pen, include those of a cartridge type into which an ink jet head and an ink reservoir are integrated and those of a combination type into which an ink jet head and an ink reservoir are combined so that the head and reservoir can be removed independently of each other. A recording unit, such as an ink jet pen, is adapted so that it can removably be attached to mounting means in an apparatus body, such as a carriage. Ink jet recording apparatuses according to the present invention include those which are provided integrally or separately as an output terminal for information processing equipment, such as word processors and computers; copying machines combined with an information reader etc., facsimile machines which send and receive information; and equipment which prints cloth.

2. Related Background Art

An ink jet recording apparatus can characteristically record a fine image fast by ejecting fine ink droplets from an ejection orifice at high speed. As disclosed in U.S. Pat. No. 4,723,129 and U.S. Pat. No. 4,740,796, ink jet recording apparatuses of such a type that ink is ejected using ink bubbling due to energy, especially thermal energy produced by an electric converter as energy producing means for producing energy used to eject ink have been the focus of attention because they can form a fine image and make a record at high speed and are suitable for reducing recording heads and recording apparatuses in size and providing color recording heads and recording apparatuses.

FIG. 1 shows a typical configuration of an ink jet head as described above.

FIG. 2 is a schematic sectional view of an ink jet recording head substrate 2000, taken along a line 2—2 passing through an ink path in FIG. 1.

In FIG. 1, the ink jet recording head has a plurality of ejection orifices 1001, and an electrothermal converting element 1002 which produces thermal energy used to eject ink through the ejection orifices is provided on a substrate 1004 for each ink path 1003.

The electrothermal converting element 1002 mainly comprises a heating resistor 1005, electrode wiring 1006 which supplies power to a heating resistor, and insulating film 1007 which protects the resistor and wiring. The ink paths 1003 are formed by jointing together a plurality of top plates with which a path wall 1008 is integrated with, while aligning the plates with the electrothermal converting elements or the like on the substrate 1004. Each ink path 1003 communicates at its end opposite to the ejection nozzle 1001 with a common liquid chamber 1009, in which ink from an ink tank (not shown) is reserved. After fed to the common liquid chamber 1009, ink is directed therefrom into each ink path 1003 and held when it forms a meniscus near the ejection nozzles 1001. Thermal energy produced by selectively driving an electrothermal converting element 1002 is used to rapidly boil ink on a heating surface, so that ink is ejected by impulse due to boiling.

In FIG. 2, reference numerals 2001 and 2002 denote a silicon substrate and a heat storing layer (interlayer film) consisting of $SiO_2$ film (heat oxidation film), SiN film, etc. Reference numeral 2003 denotes a heater; 2004, a heating resistor layer; 2005, wiring made of Al, Al—Si, Al—Cu, etc.; 2006, a least one protective layer consisting of $SiO_2$ film, SiN film, etc.; 2010, a cavitation-resistant layer made of Ta film or the like, which protects the protective layer 2006 from chemical and physical impulse accompanying heat production by the heating resistor layer 2004; and 2008, a heating section of the heating resistor layer 2004.

The heating section 2008 generates heat due to pulse application caused by ink bubbling, and ink on the section rapidly boils when the section reaches about 300° C. or more.

To bubble ink in such a way, the heating section is kept hot. In addition, to stabilize bubbling by inhibiting head quality variations and those in body driving, more energy than is required for ink to bubble need to be fed. As a result, the temperature of the heating section further increases. Under normal driving conditions, the temperature appears to reach 450° C. to 550° C.

Such a high temperature reached may cause a serious problem affecting the life of the head. The problem is that dye or pigment ink is exposed to high temperature, so that decomposition products produced by molecular chain cutting are deposited as "scorches" on the heating section; that is, "kogation" occurs.

Owing to this "kogation" decomposition products are gradually deposited on the heating section, finally making it difficult to make ink bubble stably, affecting head life.

To prevent this phenomenon, various measures have been taken, including modifying ink components, such dyes, and adding to ink a component which prevents scorches.

However, a variety of demands are made on an image which an ink jet printer prints by ejecting ink. For example, these demands include increasing printed matter water resistance, preventing intercolor breed, and improving wear resistance. To meet these demands, ink components must be further modified. However, such modification may neutralize the effects of thus far taken measures for preventing scorches, thus reposing the problem of scorches. The present invention intends to prevent scorch deposits on the heating section and prolong recording head life even if such ink is used.

Japanese Patent Application Laid-Open No. 11-240156 discloses that water-repellent film is formed in an area corresponding to the heating section to prevent scorches from being easily deposited on the heating section and thereby inhibit bubbling efficiency reduction so that ink can stably bubble.

Japanese Patent Application Laid-Open No. 11-42798 discloses that a liquid which is low in surface tension and volatility than ink to be ejected is introduced into an ink path to break hydrophobic film on the internal surface of the ink path before ink to be ejected is introduced into the path, thereby helping ink wet the internal surface so that ink is easily introduced into the path. However, the publication does not disclose prevention of scorch deposits on the heating section. The method disclosed in the publication is not expected to provide hydrophilicity strong enough to satisfactorily prevent scorch deposits.

"Chemistry and Industry" (No. 48, pp. 1256 to 1258, 1995) describes glass which is made hydophilic so that soil comes off spontaneously. "Chemistry and Industry" [No. 49(6), pp. 764 to 767, 1996] also describes the effect of photo catalyst.

"Applied Physics" [No. 64 (8), pp. 803 to 807, 1995] describes physical properties of material.

These descriptions relate to preventing soil deposits on a substrate surface or decomposing them by making the surface phydrophilic or forming a photo catalyst phydrophilic layer on the surface.

SUMMARY OF THE INVENTION

It is an object of the present invention to provide an ink jet recording head substrate, an ink jet recording head, an ink jet recording unit, and an ink jet recording apparatus which allow scorch deposits on the heating section to be prevented by exerting on the section effect of providing super-hydrophilicity, which is given by reinforcing the effect of providing hydrophilicity or effect of providing photo catalyst hydrophilicity.

It is another object of the present invention to provide an ink jet recording head substrate, an ink jet recording head, an ink jet recording unit, and an ink jet recording apparatus which allow heat to be efficiently conducted from the heating section to ink by giving the section super-hydrophilicity treatment.

An ink jet recording head substrate of the present invention with a plurality of heating resistors formed through an insulating layer on a substrate which produce thermal energy used to eject ink is characterized in that an area corresponding to a heating section in which heat produced by the heating resistors acts on ink is given super-hydrophilicity treatment and that the contact angle between the area and water is 5° or less.

An ink jet recording head substrate of the present invention, which is adapted as described above, is characterized in that a layer of an amorphous alloy with the chemical composition expressed by the following chemical formula, a cavitation-resistant upper protective layer, is provided through at least one protective layer on the heating resistors and that the amorphous alloy layer is given the super-hydrophilicity treatment:

$$Ta_{\alpha}Fe_{\beta}Ni_{\gamma}Cr_{\delta} \quad (1)$$

(where 10 atomic percent $\leqq\alpha\leqq$30 atomic percent, $\alpha+\beta<80$ atomic percent, $\alpha<\beta$, $\delta>\gamma$, and $\alpha+\beta+\delta+\gamma=100$ atomic percent).

An ink jet recording head of the present invention having an ejection orifice through which ink is ejected, an ink path which communicates with the ejection orifice and has a section exerting on the liquid thermal energy used to eject the liquid, and heating resistors which produce thermal energy is characterized in that an area corresponding to a heating section in which heat produced by the heating resistors acts on ink is given super-hydrophilicity treatment and that the contact angle between the area and water is 5° or less.

An ink jet recording head of the present invention, which is adapted as described above, is characterized in that a layer of an amorphous alloy with the chemical composition by the following chemical formula, a cavitation-resistant upper protective layer, is provided through at least one protective layer on the heating resistors and that the amorphous alloy layer is given the super-hydrophilicity treatment:

$$Ta_{\alpha}Fe_{\beta}Ni_{\gamma}Cr_{\delta} \quad (1)$$

(where 10 atomic percent $\leqq\alpha\leqq$30 atomic percent, $\alpha+\beta<80$ atomic percent, $\alpha<\beta$, $\delta>\gamma$, and $\alpha+\beta+\delta+\gamma=100$ atomic percent).

An ink jet recording unit of the present invention is characterized in that the unit has the ink jet recording head and an ink reservoir which stores ink to be fed to the ink jet recording head.

An ink jet recording apparatus of the present invention which has the ink jet recording head and recording signal feeding means for feeding a recording signal to drive the ink jet recording head is characterized in that ink is ejected from the ink jet recording head according to the recording signal to make records.

The present invention, designed as described above, prevents scorch deposits on the heating section, thus stabilizing ink ejection performance and allowing an ink jet head to be provided which lasts long and hardly depends on the components of ink. The present invention also provides an ink jet head with increased thermal conversion efficiency.

Especially, giving the heating section of an ink jet head super-hydrophilicity treatment causes the heating section to be satisfactorily wet with ink, so that thermal conductivity and bubbling efficiency increase.

The present invention allows ink jet head life to be prolonged. This is because the amorphous alloy layer, formed as a protective layer on the area, is not liable to corrosion due to various types of ink, so that the layer protects the heating resistors from chemical and physical impulse accompanying heat production by the resistors even if the area corresponding to the heating section, given super-hydrophilicity treatment, is partially washed out by cavitation impulse.

DESCRIPTION OF THE PREFERRED EMBODIMENTS

Figure 1:
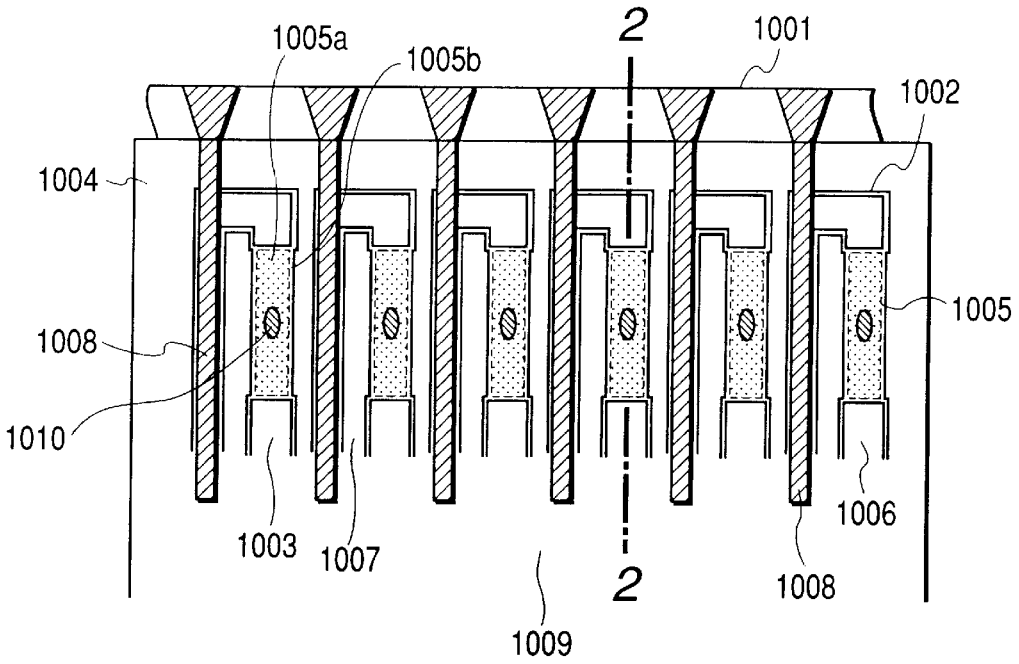
FIG. 1 is a schematic sectional view showing a common configuration of main ink jet recording head substrate components.
Figure 2:
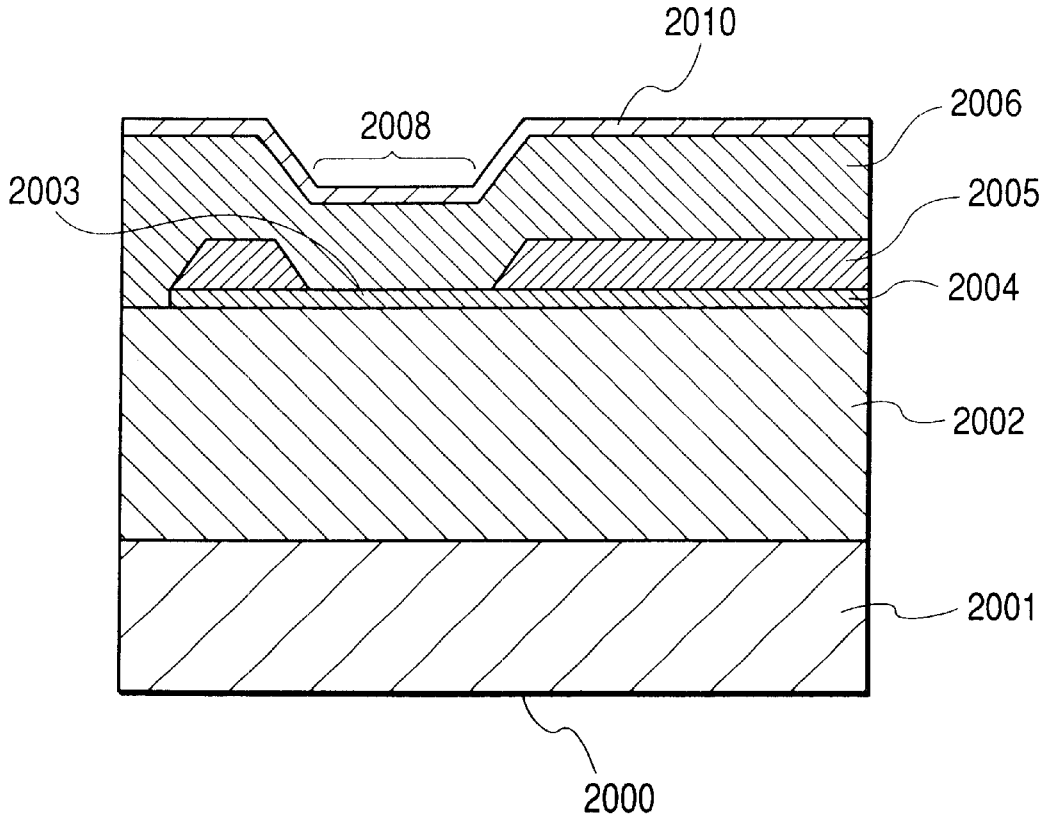
FIG. 2 is a schematic sectional view of the ink jet recording head substrate taken along a line 2—2, corresponding to an ink path in FIG. 1.

Referring now to the drawings, embodiments of the present invention will be described in detail below.

Figure 3A:
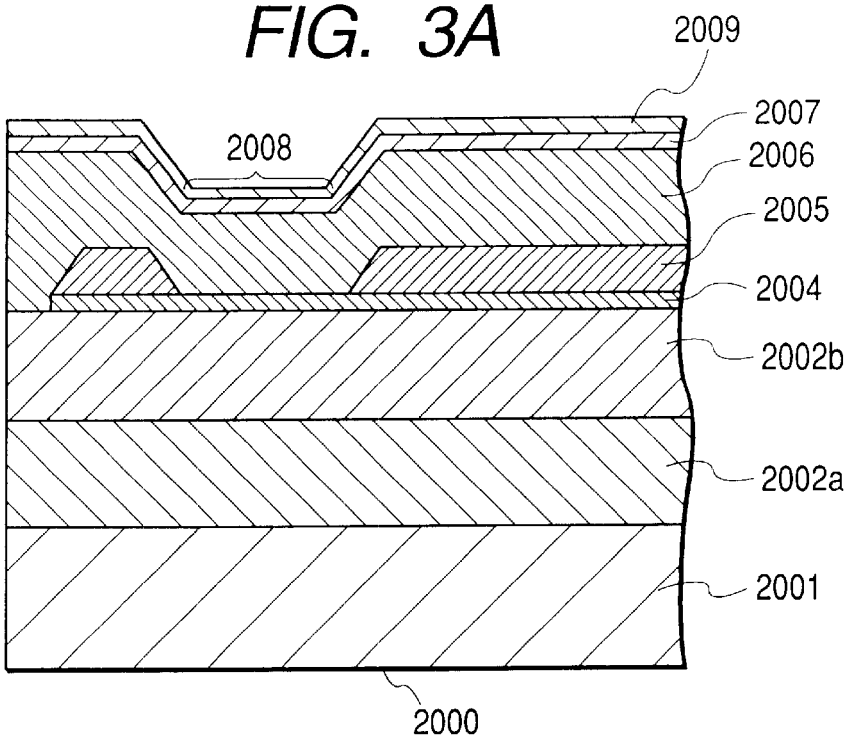
FIGS. 3A and 3B are schematic sectional views of an ink jet recording head substrate of the present invention.
Figure 3B:
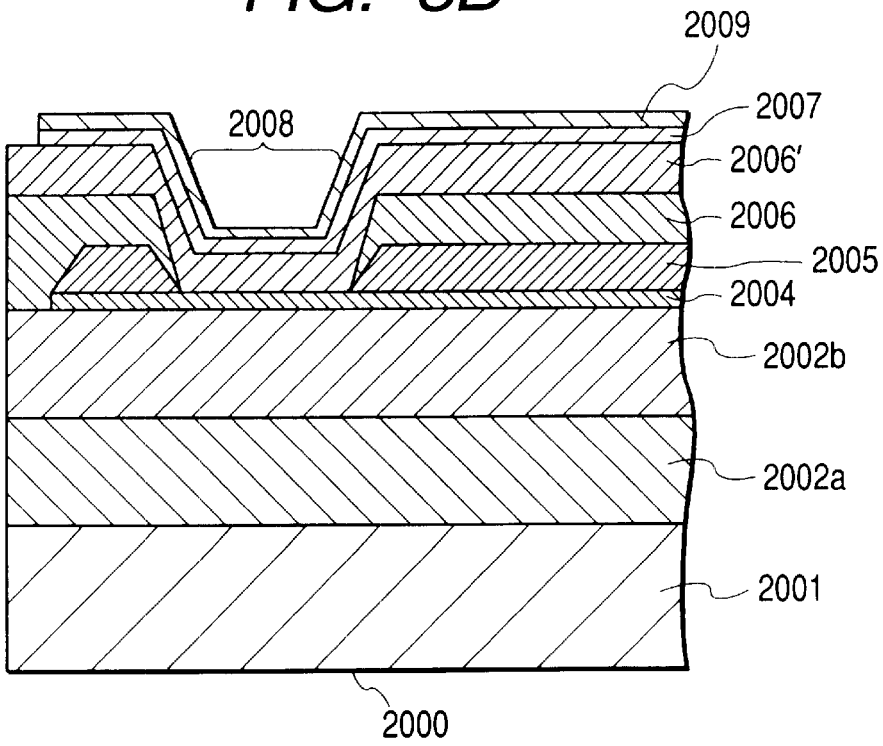

FIGS. 3A and 3B are schematic sectional views of a substrate taken along an ink path in an electrothermal converting element with heating resistors which is formed on a substrate in a head of an ink jet recording apparatus according to the present invention. That is, part of a heating resistor layer 2004 between the two opposite ends of an electrode layer 2005 constituting electrode wiring in FIGS. 3A, 3B and 9 forms heating resistors, which part is not covered with the electrode layer.

In FIG. 3A, reference numeral 2001 denotes a silicon substrate; 2002, a heat storing layer (interlayered film) formed with an $SiO_2$ film (thermal oxide film), an SiN film and the like; 2004, a heating resistor layer; 2005, an electrode layer providing wiring made of metals, such as Al, an Al—Si alloy, and an Al—Cu alloy; 2006, a protective layer also serving as insulation layer consisting of $SiO_2$ film, SiN film, etc.; 2007, an upper protective layer which protects the protective layer 2006 from chemical and physical impulse accompanying heat generation from the heating 2004 acts on ink resistors; and 2008, a heating section in which heat generated from the heating resistors in the heating resistor layer acts on ink.

The thickness of the protective layer 2006 in FIG. 3A is usually selected from a range of 0.1 to 2.0 $\mu$m.

The heating section in the ink jet head is exposed to high temperature due to heat generation from the heating resistors. The section also undergoes cavitation impulse and chemical action of ink as it bubbles or shrinks. Thus the heating section is provided with the upper protective layer 2007 to protect the electrothermal converting element from chemical action of ink.

The upper protective layer 2007 is given super-hydrophilicity treatment. In FIG. 3A, a super-hydrophilic layer 2009 is formed to give the treatment. The contact angle between the heating section with the super-hydrophilic layer formed and water is 5° or less. This in turn means that the contact angle between the ink of the heating section and water is 0° or more and 5° or less and that the contact angle between the ink of the heating section 2008 and water is 0° or more and 5° or less because of water-substrated ink used for the present invention.

Such super-hydrophilicity allows decomposition products, called "scorches," to be prevented from being deposited on the heating section 2008 and ink to bubble stably, thus prolonging head life. In addition to prevention of scorches, making the heating section super-hydrophilic increases bubbling thermal efficiency. That is, giving the heating section super-hydrophilicity treatment causes ink to thoroughly wet the heating section, thereby conducting heat to ink efficiently and increasing bubbling efficiency.

In addition to formation of the super-hydrophilic layer 2009, super-hydrophilicity surface treatment, such as fluorine plasma treatment and excimer UV ozone treatment, can be preferably applied to the present invention.

Figure 9:
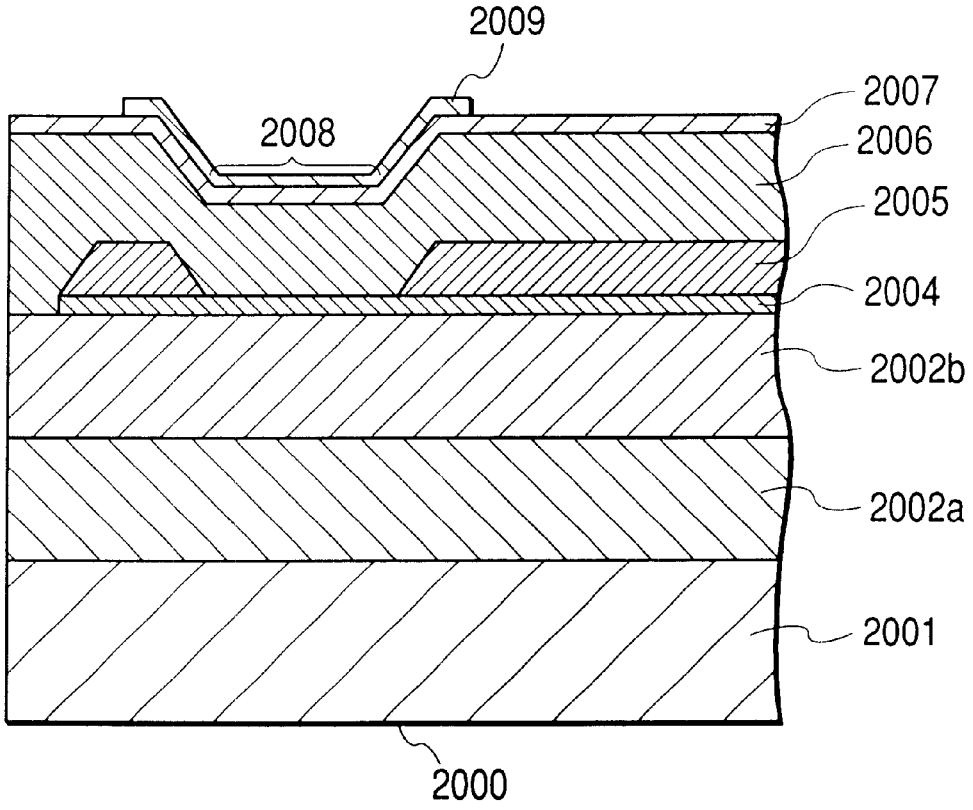
FIG. 9 is a schematic sectional view showing an ink jet recording head substrate of the present invention.

The super-hydrophilic layer 2009 in FIGS. 3A, 3B and 9, an application of super-hydrophilicity treatment, is formed with a super-hydrophilic material. The layer has a single structure made of the super-hydrophilic material or a laminated structure made of the super-hydrophilic material and a water-reserving material.

Super-hydrophilic materials which can be used include metallic oxides, such as titanium oxide, zinc oxide, tin oxide, niobium oxide, tungsten oxide, molybdenum oxide, zirconium oxide, and strontium titanate, and metallic sulfides, such as potassium sulfide, cadmium sulfide, and zinc sulfide. Water-reserving materials which can be used include $Ta_2O_5$ and $SiO_2$.

The laminated structure of the super-hydrophilic layer may be a combination of one of the above-mentioned super-hydrophilic materials and one of the above-mentioned water-reserving materials.

The super-hydrophilic material acts as a photo catalyst, so that photo catalyst reaction caused by exposure to light decomposes a trace amount of hydrophobic molecules deposited on the heating section, thus forming a thin physical absorption water layer. Thus the super-hydrophilic material exhibits super-hydrophilicity. Once the super-hydrophilic layer, which has a laminated structure made of a super-hydrophilic material and a water-reserving material, is exposed to light, the water-reserving material takes in physical absorption water, thus stabilizing super-hydrophilicity and keeping it for prolonged periods of time.

Considering ejection characteristics, it is preferable that super-hydrophilicity treatment be given to only an area corresponding to the heating section 2008, as shown in FIG. 9. The area, which corresponds to the heating section, includes a heating resistor layer between a pair of electrodes and areas adjacent to the layer.

Rather than amorphous alloy film as the upper protective layer 2007, which film will be described later, metallic oxide film formed with super-hydrophilic materials, such as titanium oxide, zinc oxide, tin oxide, niobium oxide, tungsten oxide, molybdenum oxide, zirconium oxide, and strontium titanate, can substitute for the upper protective layer 2007 and the super-hydrophilic layer 2009. Moreover, rather than not only the amorphous alloy film but $SiO_2$ film and SiN film as the protective layer 2006, the above-described metallic oxide film can substitute for the protective layer 2006, upper protective layer 2007, and super-hydrophilic layer 2009.

In FIG. 1, reference numeral 1005*a* denotes an area which is about 4 $\mu$m inside the heating resistor 1005 and helps bubbling to eject ink, or a so-called effective bubbling area. On the other hand, reference numeral 1005*b* denotes an area around the effective bubbling area, which does not help bubbling. Because scorches tend to be deposited in the middle 1010 of the effective bubbling area and near the area 1005*b* around the effective bubbling area, it is essential to prevent scorches from being deposited in these areas. The middle 1010 of the effective bubbling area 1005*a* is liable to cavitation impulse. However, even if the middle is washed out by cavitation impulse, the super-hydrophilic layer is also washed out in such a way, so that scorches are removed from the middle. Of course, if the middle 1010 of the effective bubbling area 1005*a* in the super-hydrophilic layer is not washed out, scorches are prevented from being deposited in the middle. Because the area 1005*b* around the effective bubbling area does not easily suffer cavitation impulse and the super-hydrophilic layer is not liable to be washed out, scorches are prevented from being deposited in the middle. Thus, no matter whether the super-hydrophilic layer is washed out or not, scorch deposits are effectively prevented.

Both because the upper protective layer 2007 is exposed to high temperature and because it is intended to protect the protective layer and heating resistors from cavitation impulse and chemical action of ink, the upper protective layer is required to be good at heat resistance, mechanical characteristics, chemical stability, acid resistance, and alkali resistance. Thus it is preferable that the upper protective layer 2007 be formed with an amorphous alloy of the chemical composition expressed by the following formula:

$$Ta_{\alpha}Fe_{\beta}Ni_{\gamma}Cr_{\delta} \quad (1)$$

(where 10 atomic percent $\leqq\alpha\leqq$30 atomic percent, $\alpha+\beta<80$ atomic percent, $\alpha<\beta$, $\delta>\gamma$, and $\alpha+\beta+\delta+\gamma=100$ atomic percent).

$\alpha$ in the chemical formula (1) be preferably 10 atomic percent or more and 20 atomic percent or less. $\gamma$and $\delta$ are 7 atomic percent or more and 15 atomic percent or more, respectively. It is more preferable that $\gamma$and $\delta$ be 8 atomic percent or more and 17 atomic percent or more, respectively. The upper protective layer 2007 is preferably 10 to 500 nm thick, and more preferably, 50 to 200 nm thick.

As compared with conventional Ta-based alloys, the Ta content in the amorphous alloy film is set lower, at 10 to 20 atomic percent. Using such a low Ta content allows alloy to be passivated by making it appropriately amorphous, thus significantly reducing grain boundaries at which corrosion reaction starts and enhancing ink resistance with cavitation resistance kept at a good level. Because oxides of its components are on the amorphous alloy film, and preferably, the film is covered with film of the oxides, ink resistance is further improved. That is, it is preferable that at least that surface of the upper protective layer 2007, which comes in contact with ink, be covered with film of oxides of the components of the upper protective layer 2007. The oxide film is preferably 5 nm or more and 30 nm or less thick.

Forming oxide film made mainly of Cr on the upper protective layer allows the layer to have the effect of a passivator, thus preventing corrosion by various types of ink, especially ink containing components which form divalent metal salt of Ca, Mg, etc. and chelate complexes.

A method for forming oxide film made mainly of Cr is available which heat-treats an upper protective layer in the air or oxygen. By the method, for example, an upper protective layer is heated to 50 to 200° C. in an oven. Alternatively, after an upper protective layer is formed using a spattering apparatus, oxygen gas may be introduced into the apparatus to form oxide film. Instead, after an ink jet head is formed, oxide film may be formed by impulse application driving.

FIG. 3B shows a modification of the configuration of the protective layer in FIG. 3A. In FIG. 3A, the protective layer comprises two layers so that thermal energy from the heating resistor layer 2004 more effectively acts on ink. Moreover, the protective layer is reduced in thickness (distance from the surface of the heating section to the heating resistor layer). That is, first, a first protective layer 2006 consisting of $SiO_2$ film, SiN film, etc. is formed to prevent the layer 2006 from being formed in the heating section by patterning or the like. Next, a second protective layer 2006' consisting of $SiO_2$ film, SiN film, etc. like the first protective layer is formed to thin the protective layer in the heating section. Finally, an upper protective layer 2007 is formed. Reducing the protective layer in the heating section in thickness as described above allows thermal energy from the heating resistor layer 2004 to be conducted through the second protective layer 2006' and upper protective layer 2007 to ink, so that thermal energy can more effectively be used.

Each of the above-described component layers can be formed by a known film forming method. The upper protective layer 2007, which is made of amorphous alloy, can be formed by various film forming methods. However, the magnetron spattering method is usually used which uses an RF power supply and a DC power supply.

Figure 8:
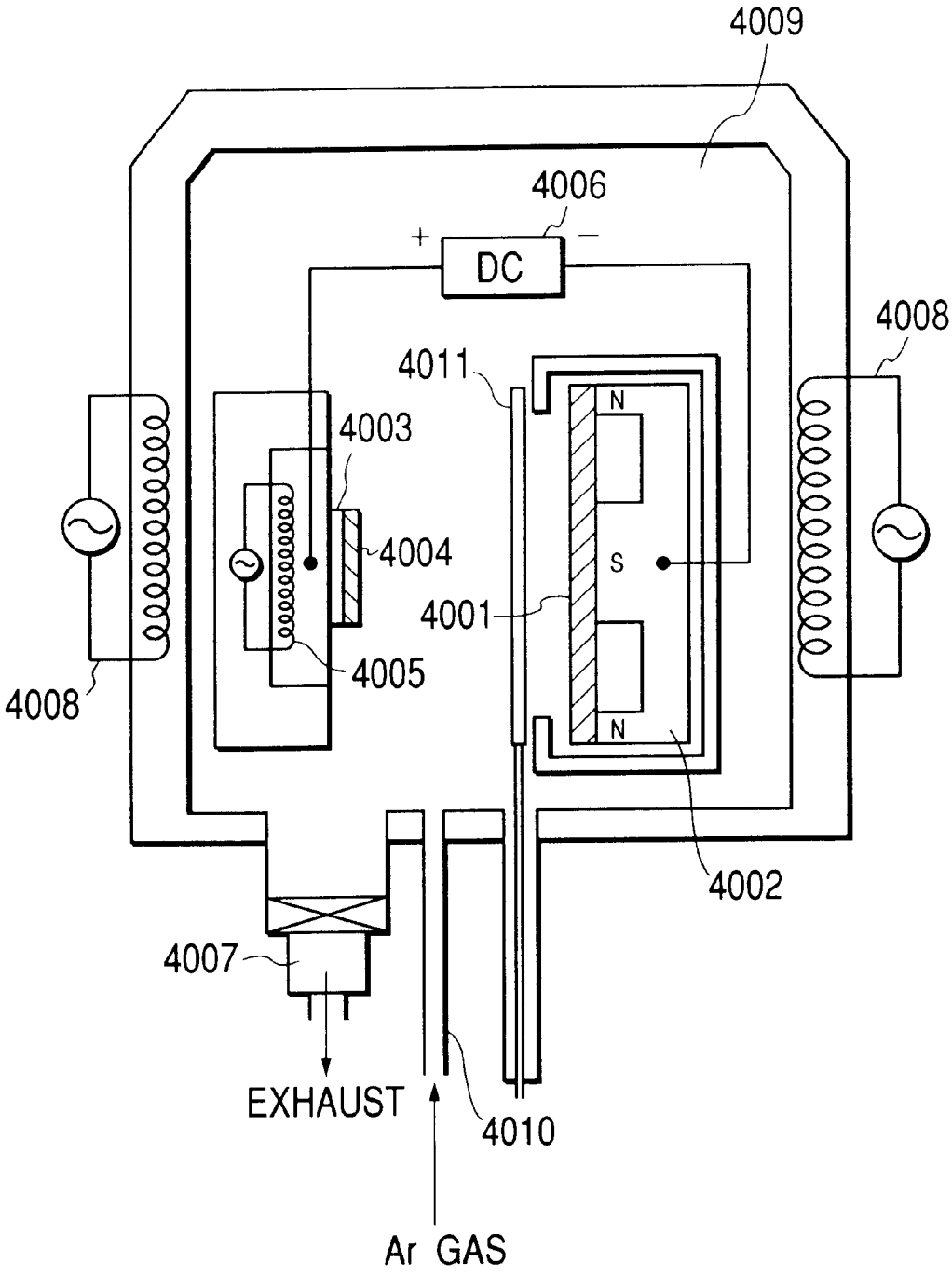
FIG. 8 is a schematic sectional view of a magnetron spattering apparatus intended to form amorphous alloy film.

FIG. 8 shows a spattering apparatus which forms the upper protective layer consisting of amorphous alloy film. In FIG. 8, a reference numeral 4001 denotes a target made of a Ta—Fe—Cr—Ni alloy of a predetermined composition, or a composition required to form an amorphous alloy layer meeting the chemical formula (1); 4002, a plain magnet; 4011, a shutter which controls film forming on a substrate; 4003, a substrate holder; 4004, a substrate; and 4006, a power supply connected to the target 4001 and substrate holder 4003. In FIG. 13, a reference numeral 4008 denotes an external heater which is provided to surround the external wall of a film forming chamber 4009. The external heater 4008 is used to control the temperature in the film forming chamber 4009. An internal heater 4005 is provided on the back of the substrate holder 4003 to control substrate temperature. It is preferable that the temperature of the substrate 4004 be controlled using not only the internal heater but the external heater 4008.

Using the apparatus in FIG. 8, film is formed as described below. First, an evacuating pump 4007 is used to evacuate the film forming chamber 4009 until a pressure of $1\times10^{-5}$ to $1\times10^{-6}$ Pa is reached. Next, argon gas is introduced at a gas inlet 4010 through a mass flow controller, not shown, into the film forming chamber 4009. When argon is introduced, the internal heater 4005 and external heater 4008 are adjusted so that a predetermined substrate temperature and a predetermined atmospheric temperature are reached. Finally, electric power is applied from the power supply 4006 to the target 4001 to perform spattering discharge, and a shutter 4011 is adjusted to form film on the substrate 4004.

Formation of the upper protective layer, made of an amorphous alloy, is not limited to the spattering method which uses the alloy target made of the Ta—Fe—Cr—Ni alloy, but film can also be formed by a binary simultaneous reactive spattering method which uses a Ta target and an Fe—Cr—Ni target and feeds electric power from two power supplies connected to each of the two targets. This method allows electric power to be applied to each target to be controlled independently.

As described above, when the upper protective layer, made of an amorphous alloy, is formed, heating the substrate to 100° C. to 300° C. provides strong film adhesion. The spattering method described above, which allows particles having relatively high kinetic energy to be produced, also provides strong film adhesion.

Similarly, giving the upper protective layer at least a compressive film stress of $1.0\times10^{10}$ dyne/cm$^2$ or less provides strong film adhesion. This film stress may be adjusted by appropriately setting the argon gas flow rate to be introduced into the film forming apparatus, electric power to be applied to the target, and temperature to which the substrate is heated.

No matter whether the protective layer provided under the above-described upper protective layer, formed with amorphous alloy film, is thick or thin, the upper protective layer can preferably be used.

Figure 5:
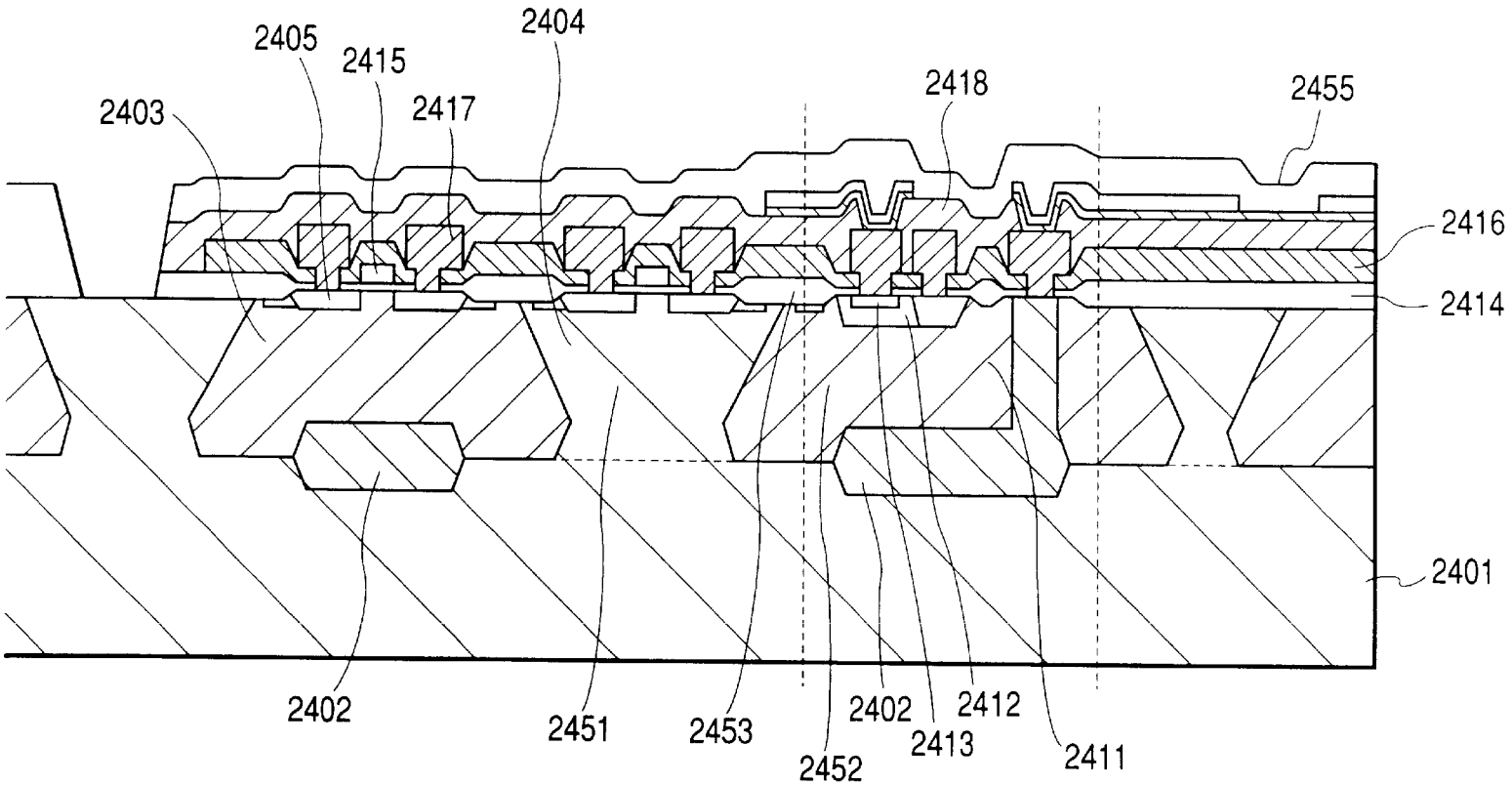
FIG. 5 is a schematic sectional view showing an ink jet recording head substrate of the present invention, especially incorporating an integrated circuit.

An ink jet head substrate of the present invention may have a structure into which an integrated circuit is incorporated as shown in FIG. 5.

The integrated circuit in FIG. 5 is formed using the following procedure.

A dopant, such as As, is introduced into a silicon substrate 2401, a P conductor, by ion implantation and diffusion to form an N-type implanted layer 2402, and an N-type epitaxial layer 2403 8 $\mu$m thick is formed on the implanted layer.

Impurities, such as B, are introduced into the epitaxial layer 2403 to form a P-type well area 2404. Then photolithography and impurity introduction by oxidation diffusion, ion implantation, etc. are repeated to form a P-MOS 2450 in the N-type epitaxial area and an N-MOS 2451 in the P-type well area.

The P-MOS 2450 and N-MOS 2451 are each formed with gate wiring 2415 made of poly-Si which is deposited through gate insulating film 50 nm thick to a thickness of 600 nm by the CVD method, a source area 2405 into which N-type or P-type impurities are introduced, a drain area 2406, etc. An NPN transistor 2452, a power transistor, is formed with a collector area 2411, a base area 2412, an emitter area 2413, etc. in the N-type epitaxial layer in steps, including impurity introduction and diffusion.

The elements are separated from each other by forming an oxide film separation area 2453 using field oxide film 1000 nm thick. Under a heating section 2455, the field oxide film functions as a first heat storing layer 2414. After the elements are formed, interlayer insulating film 2416 about 700 nm is deposited using PSG and BPSG by the CVD method and leveled by heat treatment, and wiring is installed through contact holes using a first Al electrode 2417.

Then an $SiO_2$ interlayer insulating film 2418 about 1.4 $\mu$m thick is formed by the plasma CVD method. Next, through-holes are formed to come in contact with an upper Al/TaN layer which is opposite to a lower Al layer, with interlayer insulating film in between by photolithography and dry etching. After the through-holes are completed, TaN layer formation and subsequent steps are performed to complete an ink jet substrate as in case of the silicon substrate described above.

Figure 4A:
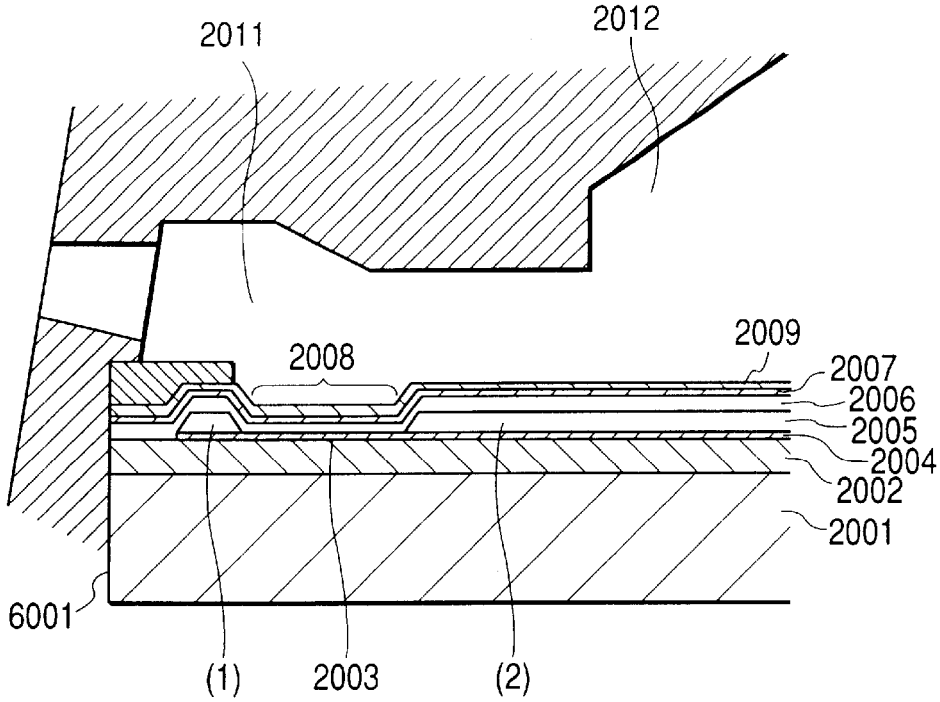
FIG. 4A is a schematic sectional view showing an example of an ink jet recording head using an ink jet recording head substrate of the present invention.

FIG. 4A is a schematic sectional view showing an example of an ink jet recording head using an ink jet head substrate 6001 of the present invention.

Figure 4B:
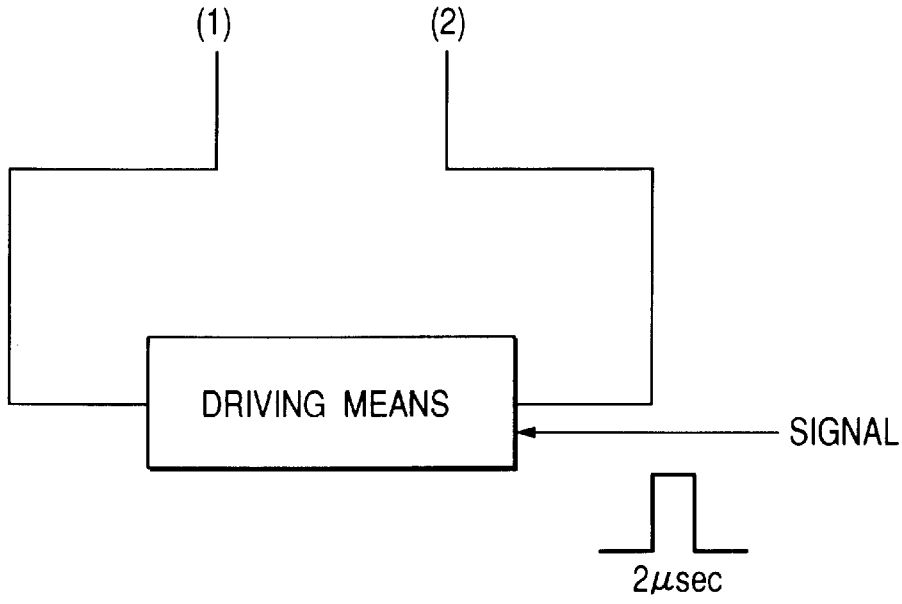
FIG. 4B is a schematic view showing driving means for driving an electrothermal converting element in the ink jet recording head in FIG. 4A.

In FIG. 4A, ink is fed from an ink tank (not shown) through a common liquid chamber 2012 to an ink path 2011 and heated at the heating section of a heating resistor by applying an electrical pulse to driving means which is connected to parts (1) and (2) of wiring as shown in FIG. 4B (for example 2 $\mu$sec signal in FIG. 4B), so that ink bubbles and bursts forth.

Figure 6:
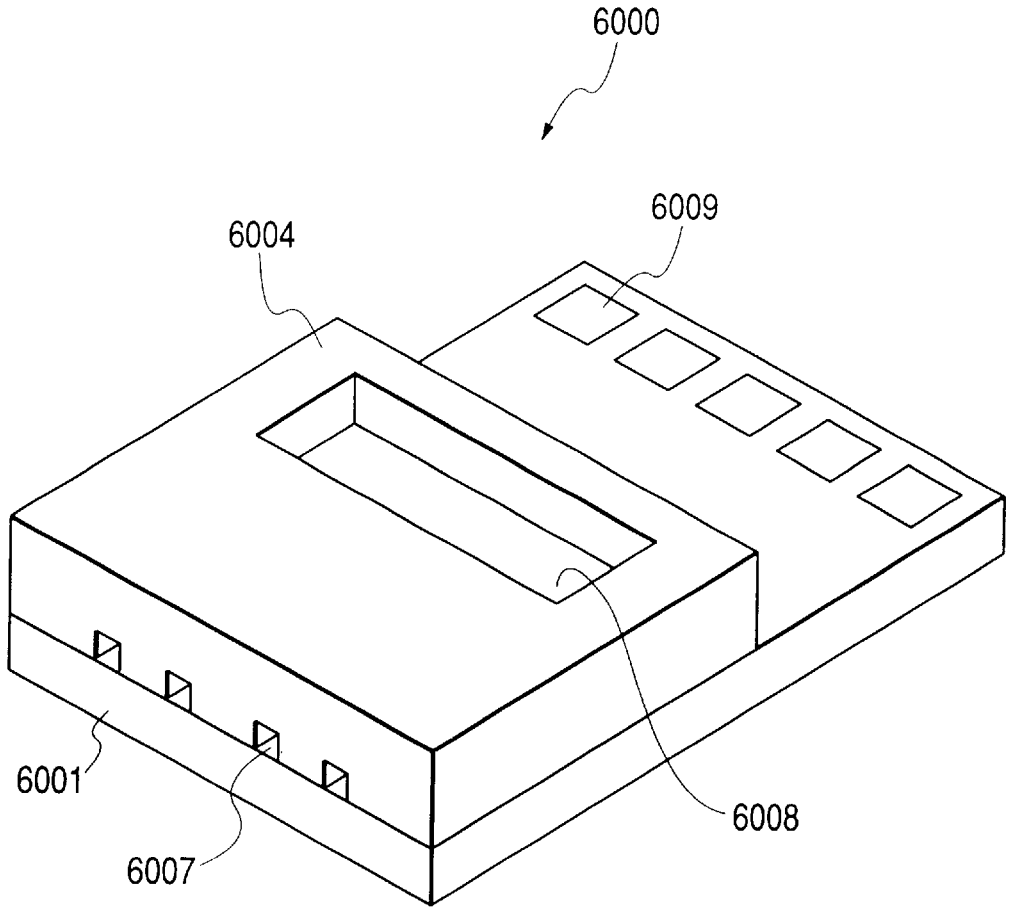
FIG. 6 is a schematic perspective view showing an ink jet recording head of an embodiment of the present invention.

FIG. 6 is a schematic sectional view showing an ink jet recording head 6000 of an embodiment of the present invention.

The ink jet recording head 6000 has an ink jet head substrate which is provided in parallel with a plurality of heat generators feeding thermal energy used to bubble ink (the heating section 2008 and so forth) and a top plate 6004, which is installed on the substrate.

The ink jet head substrate 6001 is provided with a plurality of electrode pads 6009 which are intended to input an electrical signal from outside to drive each heating resistor.

A plurality of liquid paths (ink paths 2011 in FIG. 4A and so forth) which correspond to each heat resistor and a groove which is used to form a common liquid chamber (common liquid chamber 2012 in FIG. 4A and so forth) intended to feed ink to each liquid path are formed in the top plate 6004. The top plate 6004 is jointed with the ink jet head substrate 6001 to form the liquid paths and common liquid chamber. When the ink jet head substrate 6001 and the top plate 6004 are jointed together, a groove forming a liquid path and a heating resistor are aligned with each other, thus providing a liquid path with a heating resistor. A plurality of ejection orifices 6007 which communicate with the liquid paths used to eject ink and an ink feed port 6008 through which ink is fed from outside to the common liquid chamber are provided in the top plate 6004. Such being the case, after it is fed through the ink feed port 6008 to the common liquid chamber 6006 and temporarily stored therein, ink enters the liquid paths by a capillary phenomenon and forms a meniscus at the ejection orifices 6007 to keep filling the paths. When the heating resistors are energized through an electrode (not shown), thus generating heat, ink on the heating resistors is rapidly heated, so that bubbles occur due to film boiling in the liquid paths and grow, causing ink to be ejected through the ejection orifices 6007.

Figure 7:
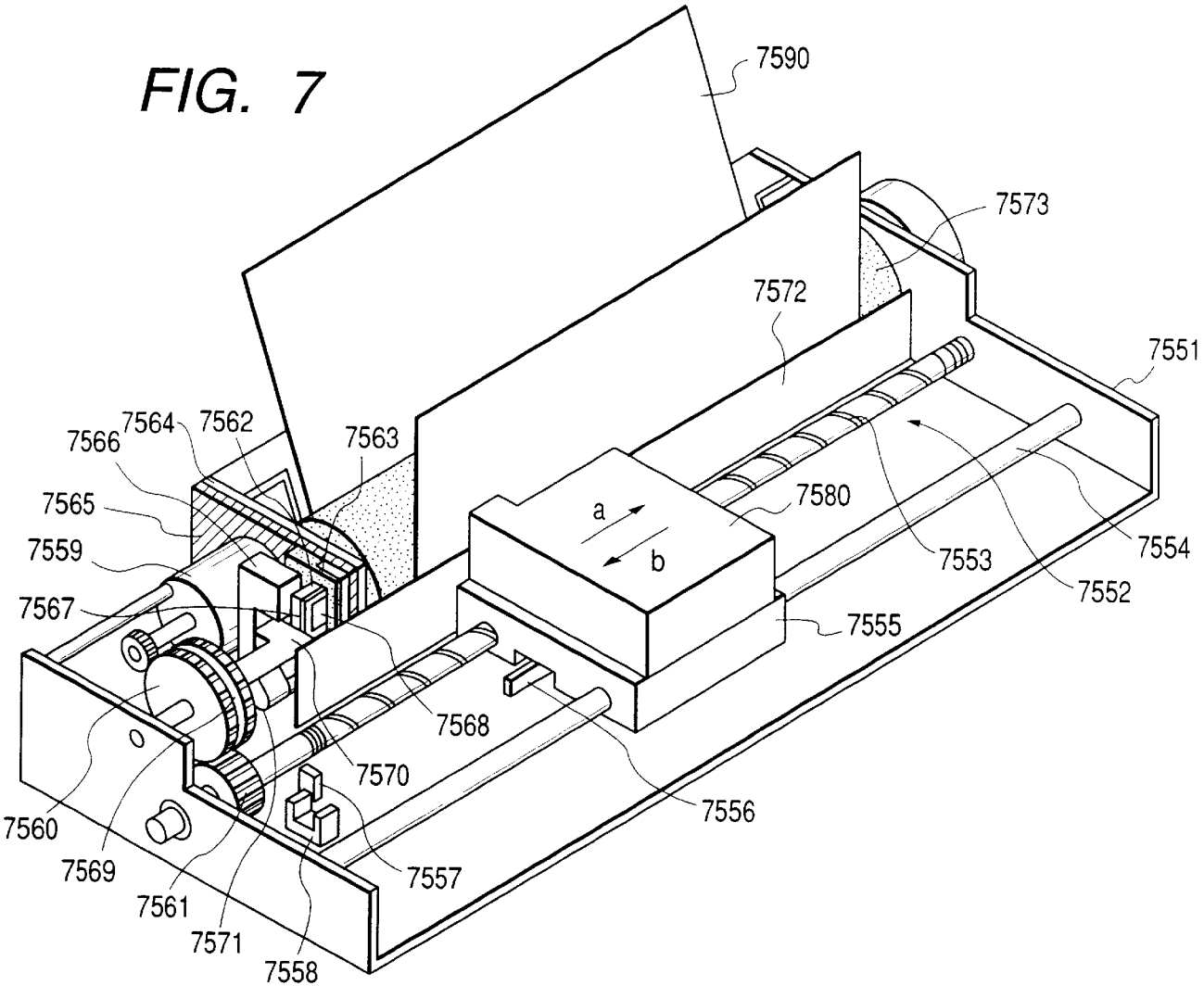
FIG. 7 is a schematic perspective view showing an ink jet recording apparatus in which an ink jet recording head of an embodiment of the present invention is installed.

Referring now to FIG. 7, an ink jet recording apparatus on which the ink jet recording head 6000 is installed will be described below.

FIG. 7 is a schematic perspective view showing an example of an ink jet recording apparatus of the present invention. In the figure, a lead screw 7552, in which a spiral groove 7553 is cut, rotatably pivots on a body frame 7551. The lead screw 7552 is rotationally driven through driving force transmission gears 7560 and 7561 as a drive motor 7559 rotates forward or backward.

A guide rail 7554, which guides a carriage 7555 so that it can freely slide, is secured to the body frame 7551. The carriage 7555 is provided with a pin (not shown) which fits into the spiral groove 7553 so that rotating the lead screw 7552 using the drive motor 7559 allows the carriage 7555 to reciprocate in the directions denoted by arrows a and b. In the direction of movement of the carriage 7555, a paper retaining plate 7572 presses against a platen roller 7573 a medium 7590 on which records are to be made.

An ink jet recording unit 7580 is installed on the carriage 7555. The ink jet recording unit 7580 may be of a cartridge type into which the above-described ink jet recording head and ink tank or a combination of these two components which is made so that they can be removed independently of each other. The ink jet recording unit 7580 is secured to the carriage 7555 and supported by positioning means and an electrical contact. The unit can also be removed from the carriage 7555.

Photocouplers 7557 and 7558 constitute home position detecting means to detect a lever 7556 of the carriage 7555 in this area and reverse the rotation of the drive motor 7559. A cap member 7567, which covers the front (surface in which the ejection orifices are open) of the ink jet recording head, is supported by a supporting member 7562. The cap member has sucking means 7566 to return the ink jet recording head to its original condition by suction through an opening 7568 in the cap. A supporting plate 7565 is attached to a body supporting plate 7564. A cleaning blade 7563, which is slidably supported by the supporting plate 7565, is moved back and forth by driving means, not shown. It goes without saying that the cleaning blade 7563 is not limited to the type shown but may of a known type. A lever 7570, which is intended to start returning the ink jet recording head to its original condition by suction, moves as a cam in contact with the carriage 7555 moves. Driving force from the driving motor 7559 is controlled by known transmitting means, such as gears 7569 and a latch switch.

These operations, that is, capping, cleaning, and returning the ink jet recording head to its original condition by suction, are performed in each corresponding position under the action of the lead screw 7552 when the carriage 7555 moves to an area on the home position side. If an arrangement is made so that a desired operation is performed at a known time, any is applicable to the embodiment.

The above-described ink jet recording apparatus has recording signal feeding means for feeding a signal to drive an electrothermal converting element of the ink jet recording head installed on the apparatus. The apparatus also has a controller which controls it.

Because the ink jet recording apparatus of the embodiment has the above-described ink jet recording head, ink ejection is stable, thus providing a recording apparatus which hardly causes image quality deterioration.

Referring now to a plurality of examples, the embodiment of the present invention will be described in detail below. Of course, the present invention is not limited to the following examples, but any combination of the examples may be used if it attains objects of the present invention.

Example 1

Referring now to FIG. 3A, a sectional view, an example 1 of the present invention will be described below.

A silicon substrate 2001 was oxidized by heating it using steam at 115° C. for six hours to form $SiO_2$ film 2002 about 2 $\mu$m thick. Further, SiN film 2002*b* of about 1 $\mu$m thick, was formed by the CVD method. TaN film about 100 nm thick was formed as a heating resistor layer 2004 by the reactive spattering method using $N_2$ gas. Al film 2005 about 600 nm thick was formed by spattering. Wiring and electrode pads were formed from Al by photolithography, and a heater was formed from TaN. SiN film about 1 nm thick, a protective layer 2006, was formed by CVD method.

$TiO_2$, a super-hydrophilic material, was deposited to a thickness of 100 nm by spattering, then $Ta_2O_5$, a water storing material, was deposited to a thickness of 50 nm by spattering also. By photolithography, these deposits were formed into a predetermined shape to provide a $TiO_2/Ta_2O_5$ layer, serving as both an upper protective layer 2007 and a super-hydrophilic layer 2009. Finally, part of the SiN film was removed by photolithography to expose Al electrode pads (not shown), thus completing an ink jet head substrate.

In the example, the contact angle between the heating section and water was 5° or less.

The ink jet head substrate made as described above and the top plate 6004 made of polysulfone in which liquid paths corresponding to heating resistors and grooves used to form a common liquid chamber intended to feed ink to each liquid path were formed were jointed together to make an ink jet head.

An ink jet recording apparatus as described above was made in which the ink jet head is to be installed.

In an ejection durability test which was performed using water-based ink containing azo dye and the ink jet recording apparatus made as described above, few scorches were deposited on the heating section when ejection pulses numbered $1\times10^8$.

Comparative Example 1

A comparative example 1 is such a head that no super-hydrophilic layer, or $TiO_2/Ta_2O_5$ layer, is formed unlike the example 1, that the heating section is a protective layer made of SiN film, and that hydrophobic film on the ink path internal walls, including the heating section, is broken by filling the ink paths with a mixture containing 50 vol % propyl alcohol and 50 vol % glycerin. For the head, the contact angle between the heating section and water was about 20°. In an ejection durability test which was performed using an ink jet recording apparatus with the head as in case of the example 1, a large amount of scorches were deposited on the heating section when ejection pulses numbered $2\times10^8$.

Example 2

An ink jet head substrate was made by forming film of $Ta_{18}Fe_{57}Ni_8Cr_{17}$, an amorphous alloy, as the upper protective layer 2007 between the protective layer 2006, made of SiN film, and the $Ti_2/Ta_2O_5$ film which were formed in the example 1. Except for this, the same configuration was used as in the example 1.

By spattering, the upper protective layer 2007 was formed using the apparatus in FIG. 8 under the following conditions.

The silicon substrate 2001 (4004 in FIG. 8), which had reached the step of forming the protective layer 2006 with SiN in the same way as in case of the example 1, was installed on the substrate holder 4003 in the film forming chamber 4009 of the apparatus in FIG. 8. Next, using the evacuating pump 4007, the film forming chamber 4009 was evacuated until a pressure of $8\times10^{-6}$ was reached. Then argon gas was introduced through the gas inlet 4010 into the film forming chamber 4009 to meet the following conditions in the film forming chamber 4009.

[Film formation conditions]

Substrate temperature: 200° C.

Temperature of gas in film forming chamber: 200° C.

Gas mixture pressure in film forming chamber: 0.3 Pa

Using a Ta target and an Fe—Ni—Cr alloy ($Fe_{74}Ni_8Cr_{18}$) target, $Ta_{18}Fe_{57}Ni_8Cr_{17}$ film 200 nm thick was formed on the protective layer 2006 by dual spattering, with electric power to be fed to the Ta target set to 300 W, and electric power to be fed to the Fe—Ni—Cr alloy target variable.

In the example, the contact angle between the heating section 2008 and water was 5° or less.

Example 3

Unlike the example 1, SiN film, the protective layer 2006, was not formed. By forming $TiO_2$ film 300 nm thick and $Ta_2O_5$ film 100 nm thick in that order, $TiO_2/Ta_2O_5$ layer serving as the protective layer 2006, upper protective layer 2007, and super-hydrophilic layer 2009 is provided to make an ink jet head substrate. Except for this, the same configuration was used as in the example 1.

In the example also, the contact angle between the heating section 2008 and water was 5° or less.

Example 4

Unlike the example 1, instead of forming the $TiO_2/Ta_2O_5$ layer, fluorine plasma treatment was given to the surface of the protective layer 2006, made of SiN film, to make an ink jet head substrate. Except for this, the same configuration was used as in the example 1.

In the example also, the contact angle between the heating section 2008 and water was 5° or less.

In the example, substituting excimer UV ozone treatment for fluorine plasma treatment gave the same result.

Example 5

Unlike the example 2, instead of forming the $TiO_2/Ta_2O_5$ layer, fluorine plasma treatment was given to the surface of the upper protective layer 2007, made of $Ta_{18}Fe_{57}Ni_8Cr_{17}$ film, to make an ink jet head substrate. Except for this, the same configuration was used as in the example 1.

In the example also, the contact angle between the heating section 2008 and water was 5° or less.

In the example, substituting excimer UV ozone treatment for fluorine plasma treatment gave the same result.

Example 6

As shown in FIG. 9, unlike the example 1, the super-hydrophilic layer 2009, a $TiO_2/Ta_2O_5$ layer, was formed in only an area corresponding to the heating section to make an ink jet head substrate. Except for this, the same configuration was used as in the example 1.

In the example, areas other than the area which corresponds to the heating section 2008 was removed by etching in the same way as in the example to form the super-hydrophilic layer 2009.

In the example also, the contact angle between the heating section 2008 and water was 5° or less.

Example 7

As shown in FIG. 9, unlike the example 2, the super-hydrophilic layer 2009, a $TiO_2/Ta_2O_5$ layer, was formed in only an area corresponding to the heating section 2008 to make an ink jet head substrate. Except for this, the same configuration was used as in the example 2.

In the example, areas other than the area which corresponds to the heating section 2008 was removed by etching in the same way as in the example to form the super-hydrophilic layer 2009.

In the example also, the contact angle between the heating section 2008 and water was 5° or less.

Example 8

As shown in FIG. 9, unlike the example 3, the super-hydrophilic layer 2009, a $TiO_2/Ta_2O_5$ layer, was formed in only an area corresponding to the heating section 2008 to make an ink jet head substrate. Except for this, the same configuration was used as in the example 3.

In the example, areas other than the area which corresponds to the heating section 2008 was removed by etching in the same way as in the example 3 to form the super-hydrophilic layer 2009.

In the example also, the contact angle between the heating section 2008 and water was 5° or less.

Example 9

Unlike the example 4, only an area which corresponds to the heating section 2008 was given fluorine plasma treatment to make ink jet head substrate. Except for this, the same configuration was used as in the example 4.

In the example 4, fluorine plasma treatment was performed as in the example 4 after areas other than the area which corresponds to the heating section 2008 were masked.

In the example also, the contact angle between the heating section 2008 and water was 5° or less.

In the example, substituting excimer UV ozone treatment for fluorine plasma treatment gave the same result.

Example 10

Unlike the example 5, only an area which corresponds to the heating section 2008 was given excimer UV ozone treatment to make an ink jet head substrate. Except for this, the same configuration was used as in the example 5.

In the example, fluorine plasma treatment was performed as in the example 5 after areas other than the area which corresponds to the heating section 2008 were masked.

In the example also, the contact angle between the heating section 2008 and water was 5° or less.

In the example, substituting excimer UV ozone treatment for fluorine plasma treatment gave the same result.

When the examples 2 through 10 were evaluated in the same way as the example 1, they were found to be as good as the example 1.

What is claimed is:

1. An ink jet recording head substrate with heating resistors which produce thermal energy used to eject ink, wherein an area corresponding to a portion in contact with the ink applies heat generated by said heating resisters to the ink, and a contact angle between the area and the ink is 5° or less, wherein a super-hydrophilicity treatment forms a super-hydrophilic layer in the area corresponding to the heating section, wherein the super-hydrophilic layer has a laminated structure made of the super-hydrophilic material and a water-reserving material.

2. The ink jet recording head substrate according to claim 1, wherein the super-hydrophilic layer is the area corresponding to the heating section.

3. The ink jet recording head substrate according to claim 2, wherein the area corresponding to the heating section is an area which corresponds to a heating resistor layer between a pair of electrodes and its adjacent areas, wherein said ink jet recording head substrate with heating resistors is formed through an insulating layer on a substrate.

4. The ink jet recording head substrate according to claim 1, wherein the super-hydrophilic material is titanium oxide, zinc oxide, tin oxide, niobium oxide, tungsten oxide, molybdenum oxide, zirconium oxide, strontium titanate, potassium sulfide, cadmium sulfide, or zinc sulfide.

5. The ink jet recording head substrate according to claim 1, wherein the super-hydrophilic material acts as a photo catalyst.

6. The ink jet recording head substrate according to claim 5, wherein the super-hydrophilic material is cavitation-resistant.

7. The ink jet recording head substrate according to claim 6, wherein the cavitation-resistant material is titanium oxide, zinc oxide, tin oxide, niobium oxide, tungsten oxide, molybdenum oxide, zirconium oxide, or strontium titanate.

8. The ink jet recording head substrate according to claim 1, wherein the water-reserving material is $Ta_2O_5$ or $SiO_2$.

9. An ink jet recording head having an ejection orifice through which ink is ejected, an ink path which communicates with the ejection orifice and has a section exerting on the liquid thermal energy used to eject the liquid, and heating resistors which produce thermal energy, wherein an area corresponding to a portion in contact with the ink applies heat generated by said heating resisters to the ink, and the contact angle between the area and the ink is 5° or less, wherein a super-hydrophilicity treatment forms a super-hydrophilic layer in the area corresponding to the heating section, wherein the super-hydrophilic layer has a laminate structure made of the super-hydrophilic material and a water-reserving material.

10. The ink jet recording head according to claim 9, wherein the super-hydrophilicity treatment is given to only the area corresponding to the heating section.

11. The ink jet recording head according to claim 10, wherein the area corresponding to the heating section is an area which corresponds to a heating resistor layer between a pair of electrodes and its adjacent areas, wherein said heating section is formed through an insulating layer on a substrate.

12. The ink jet recording head according to claim 9, wherein the super-hydrophilic material is titanium oxide, zinc oxide, tin oxide, niobium oxide, tungsten oxide, molybdenum oxide, zirconium oxide, strontium titanate, potassium sulfide, cadmium sulfide, or zinc sulfide.

13. The ink jet recording head according to claim 9, wherein the super-hydrophilic material acts as a photo catalyst.

14. The ink jet recording head according to claim 13, wherein the super-hydrophilic material is cavitation-resistant.

15. The ink jet recording head according to claim 14, wherein the cavitation-resistant super-hydrophilic material is titanium oxide, zinc oxide, tin oxide, niobium oxide, tungsten oxide, molybdenum oxide, zirconium oxide, or strontium titanate.

16. The ink jet recording head according to claim 9, wherein the water-reserving material is $Ta_2O_5$ or $SiO_2$.

17. An ink jet recording unit, wherein the unit has the ink jet recording unit according to claim 9, and an ink reservoir which reserves ink to be fed to the ink jet recording head.

18. The ink jet recording unit according to claim 17, wherein the unit is of a cartridge type into which the ink jet recording head and ink reservoir are integrated.

19. The ink jet recording unit according to claim 17, wherein the ink jet recording head and ink reservoir are removably connected together.

20. An ink jet recording apparatus including retaining means for removably retaining the ink jet recording unit according to claim 17 and recording signal feeding means for feeding a recording signal to drive the ink jet recording head, wherein ink is ejected from the ink jet recording head according to the recording signal to make records.

21. An ink jet recording apparatus including the ink jet recording head according to claim 9 and recording signal feeding means for feeding a recording signal to drive the ink jet recording head, wherein ink is ejected from the ink jet recording head according to the recording signal to make records.

* * * * *

UNITED STATES PATENT AND TRADEMARK OFFICE

CERTIFICATE OF CORRECTION

PATENT NO. : 6,435,660 B1
DATED : August 20, 2002
INVENTOR(S) : Teruo Ozaki et al.

It is certified that error appears in the above-identified patent and that said Letters Patent is hereby corrected as shown below:

Title page,
Item [56], FOREIGN PATENT DOCUMENTS, “11042798” should read -- 11-042798 --; and “11240156” should read -- 11-240156 --.

Column 1,
Line 39, “that” should read -- in which --;
Line 43, “make a” should be deleted; and
Line 63, “integrated with,” should read -- integrated, --.

Column 2,
Line 1, “fed” should read -- being fed --;
Line 13, “a” should read -- at --;
Line 40, “such” should read -- such as --; and
Line 45, “breed,” should read -- bleed, --.

Column 3,
Line 13, “phydrophilic” should read -- hydrophilic --; and phydro-” should read -- hydro --.

Column 5,
Line 12, “which” should read -- in which --.

Column 6,
Line 34, “but” should read -- but also --.

Column 7,
Line 7, “be” should read -- is --;
Lines 8 and 10, “γand” should read -- γ and --.

Column 9,
Line 44, “in” should be deleted.

Column 11,
Line 36, “polysulfone” should read -- polysulfone, --;
Line 39, “formed” should read -- formed, --;
Lines 51, 53 and 54, “that” should read -- in which --.

UNITED STATES PATENT AND TRADEMARK OFFICE

CERTIFICATE OF CORRECTION

PATENT NO. : 6,435,660 B1
DATED : August 20, 2002
INVENTOR(S) : Teruo Ozaki et al.

It is certified that error appears in the above-identified patent and that said Letters Patent is hereby corrected as shown below:

Column 12,
Lines 31, 42 and 54, “Unlike” should read -- Unlike in --; and
Line 65, “unlike” should read -- unlike in --.

Column 13,
Lines 12 and 26, “unlike” should read -- unlike in --; and
Lines 39 and 53, “Unlike” should read -- Unlike in --.

Column 14,
Lines 5 and 50, “resisters” should read -- resistors --.

Signed and Sealed this

Eleventh Day of March, 2003

JAMES E. ROGAN
*Director of the United States Patent and Trademark Office*